US005386177A

United States Patent [19]

Uhm

[11] Patent Number: 5,386,177

[45] Date of Patent: Jan. 31, 1995

[54] PLASMA KLYSTRON AMPLIFIER

[75] Inventor: Han S. Uhm, Potomac, Md.

[73] Assignee: The United States of America as represented by the Secretary of the Navy, Washington, D.C.

[21] Appl. No.: 64,321

[22] Filed: May 20, 1993

[51] Int. Cl.[6] ..... H01J 25/18; H01J 25/20

[52] U.S. Cl. ..... 315/5.39; 315/5.51; 315/39; 330/41; 330/45

[58] Field of Search ..... 315/39, 5.31, 5.39, 315/5.51; 330/41, 45

[56] References Cited

U.S. PATENT DOCUMENTS 3,099,768 7/1963 Anderson ..... 315/5.39
3,317,784 5/1967 Ferrari ..... 315/39
3,363,138 1/1968 Gruber et al. ..... 315/39
3,378,723 4/1968 Napoli et al. ..... 315/39
3,432,721 3/1969 Naydan et al. ..... 315/39
3,432,722 3/1969 Naydan et al. ..... 315/39
5,142,250 8/1992 Uhm et al. ..... 315/39 X

*Primary Examiner*—Benny T. Lee
*Attorney, Agent, or Firm*—Jacob Shuster

[57] ABSTRACT

A body of dense plasma is established within a short drift tube of a klystron amplifier between input and output resonator cavities thereof to support current modulation of microwave energy by interaction with an electron beam propagated through the drift tube. The plasma is confined to a column radially spaced from the electron beam for two-stream interaction enabling enhancement of current modulation under simultaneous high-power and high frequency operation.

5 Claims, 1 Drawing Sheet

PLASMA KLYSTRON AMPLIFIER

BACKGROUND OF THE INVENTION

This invention relates generally to the generation of intense coherent radiation in various applications, such as high gradient radio frequency accelerators and high-power radar installations. More particularly, the present invention relates to the generation of amplified microwave energy by means of a klystron type of amplifier device.

The use of a klystron amplifier within which microwave energy interacts with beam electrons is generally well known in the art, as disclosed for example in U.S. Pat. Nos. 3,274,430, 4,820,996 and 5,162,747 to EL-Hefini, Heppinstall et al. and Tammaru, respectively. U.S. Pat. No. 5,142,250 to Uhm et al. on the other hand, relates to the interaction of an electron beam with a body of plasma before it is fed to a klystron amplifier utilized as a high-power microwave generator. As to the generation of plasma itself, U.S. Pat. Nos. 3,232,046 and 5,051,659 to Meyer and Uhm et al. are of interest.

In a Klystron amplifier, the beam generated by an electron gun is propagated through a drift tube extending between input and output resonator cavities for interaction with the microwave energy thereat. Such resonator cavities respectively induce bunching or density modulation of the electrons in the beam along the drift tube and delivery of RF power by charge collection from the beam at a resonator cavity tuned to the excitation frequency of the microwave energy introduced to the input cavity. In such prior art klystron amplifiers, the cavity size and opening is inversely related to excitation frequency so that cavity size must be dimensionally reduced in order to increase excitation frequency. Resonator cavities of reduced size, however, create various problems such as shorting and electron emission at cavity gap openings where the interaction between beam electron and high-power microwave energy occurs. Prior efforts to enhance operation of high-power klystron amplifiers, involved use of plural intermediate cavities between the input and output cavities as disclosed for example in the EL-Hefini patent aforementioned. Such arrangements for enhancing high-power operation not only increase the drift space length in the klystron amplifier, but are inconsistent with its operation under high excitation frequencies. Accordingly, a major problem with the use of a relativistic klyston amplifier resides in its inability to simultaneously accommodate both high-power and high frequency operations with an acceptable degree of overall efficiency.

It is therefore an important object of the present invention to provide a klystron amplifier arrangement through which the efficiency of current modulation of an electron beam may be simultaneously enhanced with respect to high power and high frequency operation.

A further object of the invention in accordance with the foregoing objective is to provide a more efficient klystron amplifier device having a relatively short length drift space between cavities.

SUMMARY OF THE INVENTION

In accordance with the present invention, a klystron amplifier limited to two resonator cavities, is provided with a shortened drift tube between such cavities within which a body of opaque plasma is established for interaction with a beam of electrons propagated through the drift tube in radially spaced relation to such body of plasma. A two-stream instability type of interaction within the drift tube space is thereby realized for enhancing current modulation of microwave energy under high-power and high-frequency operation.

BRIEF DESCRIPTION OF THE DRAWING FIGURES

Other objects, advantages and novel features of the invention will become apparent from the following detailed description of the invention when considered in conjunction with the accompanying drawing wherein:

FIG. 1 is a schematic block diagram of a microwave modulation system associated with the present invention; and FIG. 2 is a somewhat schematic, cross-section view of a modified klystron amplifier of the system diagrammed in FIG. 1.

DETAILED DESCRIPTION OF THE PREFERRED EMBODIMENT

Figure 1:
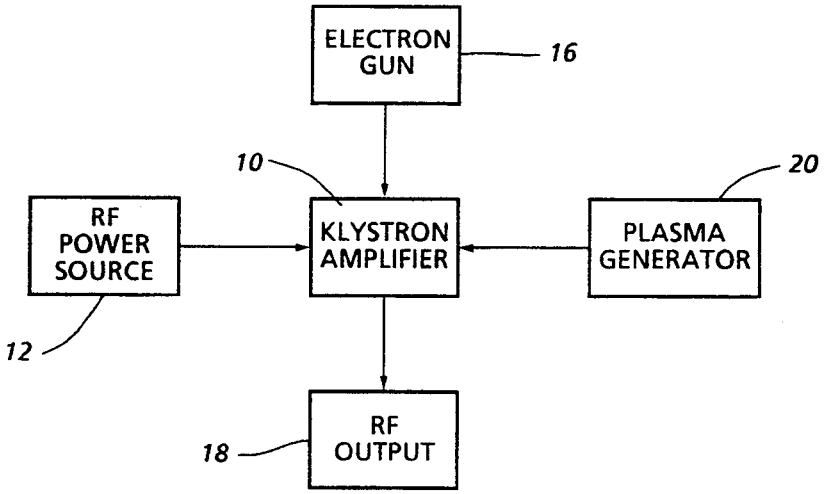

Referring now to the drawing in detail, FIG. 1 schematically diagrams a klystron amplifier 10 constructed in accordance with the present invention to which microwave energy is fed from a RF power source 12, while a beam of electrons is fed thereto from an electron gun 16. The microwave energy originating from source 12 interacts with the electrons in the beam originating from gun 16 to produce an RF output 18 from the klystron amplifier as generally understood by those skilled in the art. However pursuant to the present invention, the aforesaid interaction within the klystron amplifier 10 is modified by interaction of the beam electrons with a relatively dense body of ionized gas particles or plasma established internally within the klystron amplifier 10 by plasma generator 20.

Figure 2:
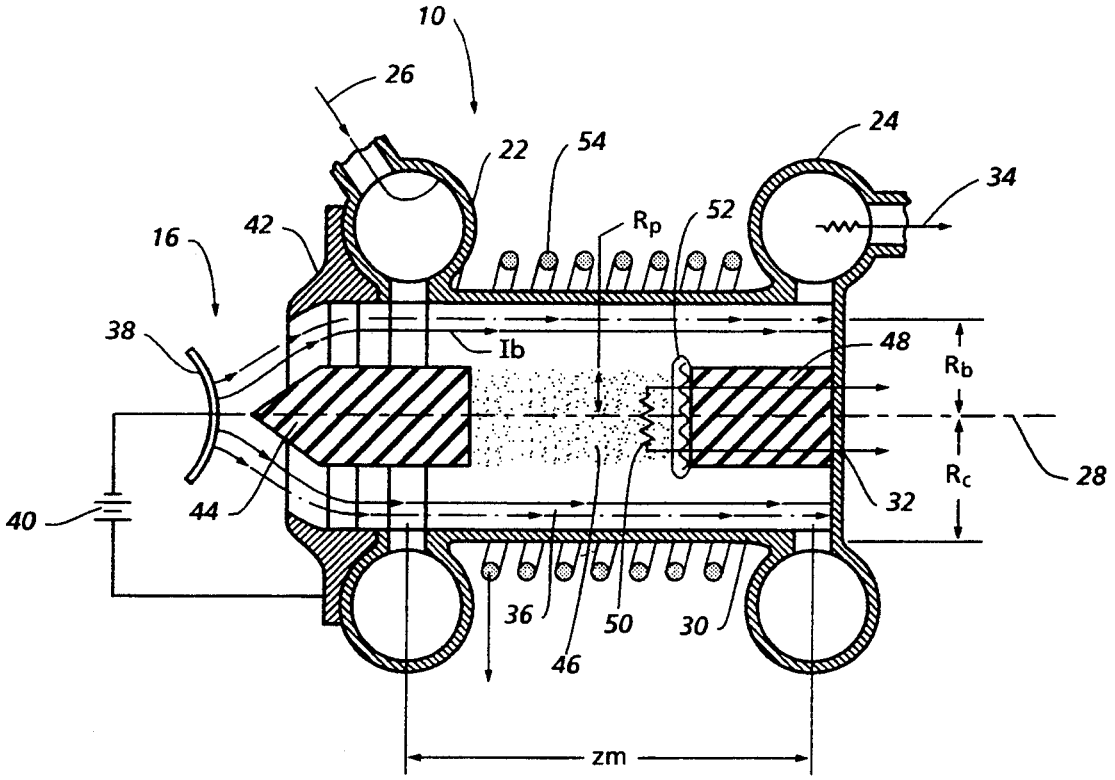

FIG. 2 illustrates the klystron amplifier 10 limited to two resonator cavities 22 and 24. One of the cavities 22 is connected to the power source 12 (see FIG. 1) receiving an RF input as indicated by reference numeral 26. Such input cavity 22 performing its bunching function is connected to and axially spaced along an axis 28 from the output cavity 24 by a cylindrical drift tube 30. Beam electrons are collected at the closed end 32 of the amplifier and microwave energy is extracted as RF energy 34 from the cavity 24 as diagrammed in FIG. 2.

An annular beam of electrons, as denoted by reference numeral 36, is propagated through the drift tube 30 from the gun 16, schematically represented in FIG. 2 as a cathode element 38 connected to a dc battery 40. The electron beam is directed into the drift tube by an anode element 42, through which an insulator body 44 projects as shown. The electron beam thus occupies an annular space having a radius ($R_b$) relative to the axis 28 of the drift tube 30 length of (Zm), which has a radius ($R_c$).

A column of plasma 46 is established within the drift tube axially between the insulator body 44 and another insulator body 48 projecting from the end 32 of the amplifier. The plasma is generated by generator 20 schematically represented in FIG. 2 by filament 50, grid 52 and coil 54. Energization of thermionic filament 50 ionizes gas within the chamber of the drift tube 30. The ionizing electrons emitted from filament 50 are reflected by grid 52 into the region between the insulator bodies 44 and 48 and are radially confined to the cylindrical volume of the plasma column 46 having a radius ($R_p$), by a magnetic field which is generated by the electromagnetic coil 54 externally mounted on the drift tube 30 as shown in FIG. 2. Thus, the plasma column 46 is radially spaced from the annular electron beam 36 by a distance of $(R_b-R_p)$, in the illustrated embodiment, during interaction between the beam electrons and the body of plasma located internally within the interaction space of the drift tube between cavities 22 and 24. The interaction which ordinarily occurs between the input microwave energy and the beam electrons is thereby modified by the body of plasma produced by thermionic arc discharges from filament 50 of the plasma generator. Such plasma is sufficiently dense or opaque so as to sustain a growth rate $(X_i)$ for a normalized two-stream instability type of modified interaction established as a slowly changing function of the plasma density $(N_p)$ and also sensitive to electron beam current $(I_b)$. Thus, the length $(Z_m)$ of the drift tube 30 may be considerably shortened by increasing the beam current $(I_b)$ through control of gun 16 or by increasing the ratio $(R_b/R_c)$ of the beam radius $(R_b)$ to the drift tube radius $(R_c)$. Also, it was found by analysis that a relatively low-power, microwave input to cavity 22 can excite the two-stream instability interaction within the plasma column region necessary to deliver a highly modulated electron beam to the extraction cavity 24. Further, the drift tube length $(Z_m)$ was found to be inversely proportional to the normalized growth rate $(X_i)$ aforementioned, as well as the excitation frequency of the input microwave energy.

The foregoing described physical characteristics and attributes of the present invention were derived from analyses carried out with respect to experimental models conforming to FIG. 2 of the drawing which does not label the non-dimensional parameters involved. Based on a normal mode approach in which all perturbations $(\delta\phi)$ as a function of growth rate (x) and time (t) are assumed to vary according to $\delta\phi(x,t)=\phi(r)\exp[i(kz-\omega t)]$, where $\phi(r)$ is a function of eigenvalue (r), (z) is the length of the plasma column 46, $\omega$ is the eigenfrequency and k is the axial wave number, the eigenfunction of the longitudinal two-stream instability is reflected by the axial electric field $E_z(r)$. From a straightforward calculation, the eigenvalue equation for $R_p<r<R_c$ is expressed as:

$$\left(\frac{1}{r}\ \frac{\partial}{\partial r}\, r\frac{\partial}{\partial r} - p^2\right)E_z(r) = -\frac{\delta(r-R_b)}{R_b}\,\sigma_b E_z(r), \tag{1}$$

which is contributed to by beam electrons. In Equation (1), the source function $\sigma_b(\omega,k)$ is defined as:

$$\sigma_b(\omega,k) = \frac{2v}{\gamma_b^3}\ \frac{k^2c^2-\omega^2}{(\omega-k\beta_b c)^2}.$$

Budker's parameter $v$ is related to the beam current $I_b$ by $v=eI_b/m\beta_b c^2$, where $p^2=k^2-\omega^2/c^2$ and $\gamma_b=(1-\beta_b^2)^{-\frac{1}{2}}$ is the relativistic mass ratio of beam electrons, c being the speed of light in vacuum while $-e$ and m are charge and rest mass, respectively, of electrons. The eigenvalue equation inside the plasma column 46 is:

$$\frac{1}{r}\ \frac{\partial}{\partial r}\left[r\left(1-\frac{\omega_p^2k^2}{v_e^2p^2}\right)\frac{\partial}{\partial r}E_z(r)\right]- \tag{3}$$

-continued $$p^2\left(1-\frac{\omega_p^2}{\omega^2}\right)E_z(r) = 0,$$

where $\omega_p^2=4\pi e^2n_p/m$ is the plasma frequency-squared of plasma electrons, and $(v_e)$ is the vortex frequency of plasma electrons defined as:

$$v_e^2=\omega^2[1+(\omega_p^2/p^2c^2)]. \tag{4}$$

Equations (1) and (3) complete the eigenvalue equation for the eigenfunction $E_z(r)$ of the longitudinal two-stream instability in the beam-plasma interaction system.

To solve the eigenvalue equation, it is assumed that the plasma density is uniform inside and drops abruptly at $r=R_p$. For present purposes of stability analysis under the long-wavelength low-frequency perturbation conditions, the eigenvalue equation is solved and the dispersion relation of the two-stream instability is expressed as $$1-\frac{\epsilon_b(k^2c^2-\omega^2)}{(\omega-k\beta_b c)^2}+\frac{\epsilon_p(k^2c^2)-\omega^2)}{\omega^2}-\frac{g\epsilon_b\epsilon_p(k^2c^2-\omega^2)^2}{\omega^2(\omega-k\beta_b c)^2}, \tag{5}$$

where the parameters $\epsilon_b$ and $\epsilon_p$ are defined as:

$$\epsilon_b = \frac{2v}{\gamma_b^3}\ln\left(\frac{R_c}{R_b}\right) \tag{6}$$

and $$\epsilon_p = \frac{\xi I_1(\xi)}{I_0(\xi)}\ln\left(\frac{R_c}{R_p}\right), \tag{7}$$

and the geometrical factor g is defined by $g=\ln(R_b/R_p)/\ln(R_c/R_p)$. In Equation (7), $\xi=\omega_pR_p/c$ and $I_n(x)$ is the modified Bessel function of the first kind of order n. Equation (5) on the other hand is utilized to investigate properties of the longitudinal two-stream instability in the annular electron beam 36 propagating through drift tube 30.

Stability analysis of the dispersion relation in Equation (5) was furthermore based on contacts between the beam and the plasma, i.e., the aforementioned geometrical factor $g=0$, so that the last term in Equation (5) was neglected and the dispersion relation significantly simplified. Defining the phase velocity of the unstable wave by $\omega/k=\beta_p c$, the instability condition is expressed as:

$$(\epsilon_b^{\frac{1}{3}}+\epsilon_p^{\frac{1}{3}})^3>\gamma_p^2\beta_b^2 \tag{8}$$

where $$p^2=(1-\beta_p^2)^{-1}$$

The electron beam velocity in the plasma klystron amplifier 10 is close to the speed of light $(\beta_b\approx 1)$ for high power. Instability occurs only when the parameter $(\epsilon p)$ is in the order of unity or larger, as evident from Equation (8). In such context, the plasma klystron amplifier 10 requires a relatively dense or opaque plasma, and the parameter $\epsilon_b<<\epsilon_p$. In such cases, the phase velocity of the unstable wave is close to the beam velocity and the dispersion relation in Equation (5) is further simplified.

From the definition of Doppler-shifted frequency $x=(\omega-k\beta_b c)/kc$, it is determined that the maximum growth rate ($X_i$) occurs at the beam velocity satisfying $\gamma_p^2\beta_b^2=\epsilon_p$ and is expressed as:

$$X_i = Im(x) = \frac{\sqrt{3}}{2b}\left(\frac{\epsilon_b\sqrt{\epsilon_p}}{2}\right)^{\frac{1}{3}} \tag{9}$$

It is noted from Equation (9) that the typical growth rate ($X_i$) of instability for an opaque plasma of rest mass length 1m, ($\epsilon_b << \epsilon_p$) increases slowly as the plasma density increases, or is almost linearly proportional to the one-twelfth power of the plasma density ($n_p$). On the other hand, the growth rate ($X_i$) of instability is linearly proportional to the one-third power of the beam current ($I_b$), displaying a sensitive dependence on beam intensity. Thus, a constant relationship of $n_p I_b^4$ between the beam current ($I_b$) and plasma density ($n_p$) is established to assure a constant growth rate. Increasing the beam current ($I_b$) by 1.7 times, will thus reduce the plasma density ($n_p$) by one order in magnitude without suffering growth rate ($X_i$).

Based on the foregoing relationships, an annular electron beam with radius of $R_b=2$ cm and energy of $_{67}$ $_b=1.67$ was provided in drift tube 30 having a radius ($R_c$) of 2.5 cm. The plasma column 46 with a radius ($R_p$) of 2 cm and density ($n_p$) of $6.5\times10^{11}$ cm$^{-3}$ was also provided. Under such conditions, the parameters $\xi$ and $\epsilon_p$ were calculated to be $\xi=3.2$ and $\epsilon_p=0.7$, respectively. The electron beam current ($I_b$) was assumed to be 5.5 kA, which corresponds to $\epsilon_b=0.037$ for the aforementioned beam parameters. The normalized electron beam velocity ($\beta_b$) was 0.8. Such beam and plasma parameters satisfy the instability criterion of Equation (8). Therefore, the normalized growth rate ($X_i$) was estimated to be 0.17 from Equation (9). The plasma column 46 for the plasma klystron amplifier 10 can accordingly be produced by thermionic arc discharges under room-temperature vapor pressure of mercury, which provides plasma densities ($n_p$) in an opaqueness range of $10^9$ cm$^{-3}$ to $10^{13}$ cm$^{-3}$ for a drift tube 30 of a length ($Z_m$) between 10 and 30 cm.

In regard to current modulation of the electron beam 36 propagating through the radial space between the plasma column 46 and the wall of drift tube 30, an axial electric field accompanied by the electron beam premodulated by the input energy from source 12 enters such region and initiates excitation of space charge wave. The plasma column responds to the initial perturbations of the axial electric field and amplifies the field strength by acting as an inductive medium. The physical mechanism of the field amplification is based on the two-stream instability hereinbefore described. Assuming the initial condition of a beam segment entering the drift tube region at a time ($t_o$), the axial electric field $E_z(z,t_0)$ acting on such beam segment is expressed as:

$$E_z(\zeta,\Theta)=-E_0 exp(x_i\zeta/\beta_b)\sin\Theta, \tag{10}$$

where $E_0$ is the initial axial electric field and $\zeta=\omega z/\beta_b c$ is the normalized propagation distance. $\Theta=\omega t_0$ on the other hand determines the normalized time while the normalized growth rate of the instability ($x_i$) is obtained in accordance with Equation (9).

Energy modulation of the beam segment is obtained from $d\gamma/dz=-eE_z/mc^2$. Without loss of generality, it is assumed that the axial coordinate z equals zero at the beginning of the plasma column. Integrating along the propagation distance and neglecting initial modulation, the relativistic mass ratio is expressed as:

$$\gamma(\xi,\Theta)=\gamma_b+\epsilon_0 exp(x_i\zeta/\beta_b)\sin\Theta, \tag{11}$$

with respect to the segment $\Theta$ at the propagation distance $\zeta$. In Equation (11), $\epsilon_0=\beta_b^2 eE_0/mc\omega x_i << 1$. The instantaneous velocity $\beta(\zeta,\Theta)c$ of the beam segment $\Theta$ is expressed as:

$$\frac{\beta_b}{\beta} = 1 + \frac{\gamma_b-\gamma}{\gamma_b(\gamma_b^2-1)}, \tag{12}$$

where $\beta_b c$ is the beam velocity at the injection point. Making use of the velocity definition $dz/dt=\beta c$ and the definition $\Phi=\omega t$, the following equation is obtained:

$$\phi = \theta = \zeta - \epsilon\exp\left(\frac{X_i}{\beta_b}\zeta\right)\sin\theta, \tag{13}$$

where use has been made of the fact that the parameters $\epsilon=\epsilon_0\beta_b/\gamma b(\gamma b^{2-1})x_i << 1$. Equation (13) relates the present time (t) to the initial time $t_0$. Differentiating $\phi$ in Equation (13) with respect to $\Theta$ gives:

$$\frac{d\phi}{d\theta} = 1 - \epsilon\exp\left(\frac{x_i}{\beta_b}\zeta\right)\cos\theta. \tag{14}$$

The beam current ($I_b$) at the injection point is a constant value. The beam segment under initial condition passes the injection point at time $t=t_0$. When this segment arrives at (z) in time (t), it is stretched by a factor of $dt/dt_0$. Thus, the beam current of such segment at (z) is proportional to $d\Theta/d\Phi$. In this regard, the normalized current ratio $F(\zeta,\Theta)$ is expressed as:

$$F(\zeta,\theta) = \frac{I(\zeta,\theta)}{I_b} = \frac{N(\zeta)}{|d\phi/d\theta|}, \tag{15}$$

where the normalization constant $N(\zeta)$ is defined as:

$$\frac{2\pi}{N(\zeta)} = \int_0^{2n} |d\theta/d\phi|\, d\theta. \tag{16}$$

The normalization constant $N(\zeta)$ ensures charge conservation.

Substituting Equation (14) into Equations (15) and (16) gives the current modulation, as:

$$F(\zeta,\theta) = \begin{cases} \sqrt{1-f^2/}\,(1-f\cos\theta), & \zeta<\zeta, \\ N(\zeta)/|1-f\cos\theta|, & \zeta>\zeta_m, \end{cases} \tag{17}$$

where the exponential function $f(\zeta)$ is defined by:

$$f(\zeta)=\epsilon\exp(x_i\zeta/\beta_b). \tag{18}$$

The normalization constant $N(\zeta)$ calculated from Equation (15) and the propagation distance $\zeta_m$ for maximum current modulation is obtained from $f(\zeta_m)=1$. Note that the current profile according to Equation (17) has a singular point at the propagation distance $\zeta=\zeta_m$ and at the parameter $\Theta=2n\pi$, displaying an infinite peak value because of approximation utilized in the derivation of Equation (17), neglecting the self-electric field resulting from the beam bunching. By introducing the self-electric field of beam bunching into the analysis, the singularity at $\zeta=\zeta_m$ is eliminated. Otherwise, the effect of the self-electric field is negligibly small. However, the level of current modulation is very high, despite the introduction of the self-field phenomenum resulting from the foregoing referred to beam bunching. It is obvious from Equation (17) that the modulated beam current has one peak per period until the beam segment $\Theta$ reaches $\zeta=\zeta_m$. If the beam propagates further from $\zeta=\zeta_m$, it starts to bunch two peaks per period, thereby providing a possibility of high harmonic modulation.

A single charge bunch per period occurs at the propagation distance in the range of $0<\zeta<\zeta_m$, where the fundamental mode dominates. Thus, analysis of the plasma klystron amplifier 10 for the fundamental mode must focus on this propagation range. In order to systematically investigate mode evolution in current profile, the current modulation of Equation (17) is Fourier-decomposed for $\zeta<\zeta_m$, i.e., $F(\zeta, \Theta)=a_0/2+\Sigma a_l \cos l\Theta$, where the coefficients $a_l(\zeta)$ are defined as:

$$a_l(\zeta) = \frac{1}{\pi}\int_0^{2\pi} F(\zeta,\theta)\cos l\theta d\theta. \tag{19}$$

Substituting Equation (17) into Equation (19), the mode strength $a_l(\zeta)$ for the mode number l is given by:

$$a_l(\zeta) = 2\,[(1-\sqrt{1-f^2})\,/f]^l, \tag{20}$$

when the exponential function $f(\zeta)$ in Equation (18) is less than unity. The beam current ($I_b$) is highly modulated in the vicinity of the propagation distance ($\zeta_m$). The mode strength is $a_l=2$ at $\zeta=\zeta_m$ for all modes, displaying a broad spectrum. At the beginning of the propagation distance, where the function $f(\zeta)$ is considerably less than unity, Equation (19) clearly exhibits an exponential growth of the fundamental mode (l=1) in current modulation.

The propagation distance along drift length ($z_m$) for maximum current modulation is expressed as:

$$Z_m = \frac{\beta_b c}{\omega}\zeta_m = \frac{\beta_b^2 c}{\omega x_i}\ln\left(\frac{1}{\epsilon}\right), \tag{21}$$

which has a significant meaning because it determines the length of the klystron amplifier. Remember that the parameter $1/\epsilon$ in Equation (21) is much larger than unity in general. Several points are noteworthy from Equation (21). First, the drift tube length ($z_m$) is inversely proportional to the normalized growth rate ($x_i$). Second, the tube length is proportional to $\ln(1/\epsilon)$, indicating that it is a weakly dependent function of the initial energy modulation at the first cavity 22. Third, the length of the microwave tube is inversely proportional to the frequency. Equation (21) also indicates that the tube length can be drastically reduced by decreasing the beam energy. As an example, consider a system where $\epsilon=0.01$, $x_i=0.13$, $\beta_b=0.8$, and the microwave frequency is 3.5 GHz. Substituting these parameters into Equation (21), the tube length ($z_m$) is determined to be 30 cm.

The foregoing parameters are easily attainable in accordance with the present invention, as well as other system parameters within a broad range allowed by present technology, to provide a plasma klystron amplifier 10 having a potential for simutaneous high-power and high-frequency microwave applications. Many different plasma configurations may be advantageously utilized, including for example an electron beam propagated through a large cylindrical plasma volume.

Numerous other modifications and variations of the present invention are possible in light of the foregoing teachings. It is therefore to be understood that within the scope of the appended claims the invention may be practiced otherwise than as specifically described.

What is claimed is:

1. In combination with a source of microwave energy and an electron gun from which an electron beam is emitted, a klystron amplifier having a drift tube extending between resonator cavities, an interaction between the microwave energy applied thereto from the source and the electron beam emitted from said gun ocurring in said drift tube and said klystron amplifier including means for enhancing current amplification of the microwave energy applied thereto, including: means for establishing a column of plasma within the drift tube, and an insulator body mounted within the drift tube and projecting along an axis therefrom toward the electron gun, said electron beam being substantially confined by the insulator body to an annular volume which is radially spaced from and surrounds said column of plasma, whereby said interaction with the microwave energy respectively occurs at the resonator cavities and with the column of plasma.

2. In combination with a source of microwave energy and an electron gun from which an electron beam is emitted, a klystron amplifier having a drift tube extending between resonator cavities, an interaction between the microwave energy applied thereto from the source and the electron beam emitted from said electron gun occurring in said drift tube and said klystron amplifier including means for enhancing current amplification of the microwave energy applied thereto, including: means for establishing a centrally located column of plasma extending along an axis within the drift tube and means for substantially confining said electron beam to an annular volume within the drift tube which is radially, spaced from and surrounds said centrally located column of plasma, whereby said interaction thereof with the microwave energy occurs at the resonator cavities and with the column of plasma.

3. The combination of claim 2 wherein said column of plasma is opaque.

4. The combination of claim 3 wherein said opaque plasma has a density approximately between $10^9$ and $10^{13}$ particles of ionized gas per cubic centimeter.

5. In combination with a source of microwave energy and an electron gun from which an electron beam is emitted, a klystron amplifier having a drift tube extending between resonator cavities, the microwave energy applied from the source interacts with the election beam emitted from said electron gun at said drift tube, said klystron amplifier including means for establishing a body of plasma within the drift tube and means for propagating said electron beam through the drift tube in spaced relation to the body of plasma, wherein said body of plasma comprises ionized gas particles of predetermined density confined to a column centrally located between said resonator cavities, the beam of electrons being in radially spaced relation thereto by a predetermined distance thereby surrounding the body of plasma.

* * * * *